United States Patent [19]

Hasegawa et al.

[11] 4,306,025

[45] Dec. 15, 1981

[54] METHOD FOR RECOVERING MYELOPEROXIDASE AND PHARMACEUTICAL COMPOSITION CONTAINING MYELOPEROXIDASE AS MAJOR CONSTITUENT

[75] Inventors: Eichi Hasegawa; Takashi Kobayashi, both of Hirakata, Japan

[73] Assignee: The Green Cross Corporation, Osaka, Japan

[21] Appl. No.: 179,783

[22] Filed: Aug. 20, 1980

[30] Foreign Application Priority Data

Dec. 28, 1979 [JP] Japan ..... 54-172109
Feb. 22, 1980 [JP] Japan ..... 55-22113

[51] Int. Cl.[3] ..... C12N 9/08

[52] U.S. Cl. ..... 435/192; 435/816; 424/94

[58] Field of Search ..... 435/192

[56] References Cited

PUBLICATIONS

Methods in Enzymology, vol. 2, pp. 794–801, (1955).
Chemical Abstracts, 94:134695e, (1981).
Advances in Enzymology, vol. 3, pp. 137–148, (1943).

*Primary Examiner*—Lionel M. Shapiro
*Attorney, Agent, or Firm*—Cushman, Darby & Cushman

[57] ABSTRACT

Myeloperoxidase can be separated and recovered from a supernatant liquid of an aqueous dispersion of a disintegration product of human myelogenous leukocytes, which dispersion has been admixed with at least one member selected from the group consisting of manganese salts and protamine sulfate. The recovered myeloperoxidase in combination with an alkali metal halide can be used as a pharmaceutical composition effective against microorganisms deficient or diminished in catalase synthesizing activity.

8 Claims, No Drawings

METHOD FOR RECOVERING MYELOPEROXIDASE AND PHARMACEUTICAL COMPOSITION CONTAINING MYELOPEROXIDASE AS MAJOR CONSTITUENT

This invention relates to a method for separating and recovering myeloperoxidase from human myelogenous leukocytes and to a germicidal remedy containing the myeloperoxidase as major constituent.

Myeloperoxidase is an enzyme first found in 1941 by Agner in animal leukocytes [Agner, Acta Physiol. Scand., 2, Suppl., 8 (1941)]. It is contained in large quantity together with lysozyme in myelogenous white blood cells, especially in neutral multinuclear leukocytes and in monocytes, the content amounting up to 5% based on the weight of neutrophils.

This enzyme has basic nature with a molecular weight in the order of 120,000 to 150,000 Dalton. Its molecule consists of two analogous subunits and contains two iron atoms, the one existing in the form of heme iron and the other non-heme. It belongs to a group of oxidoreductases.

The physiological function of the myeloperoxidase seems to produce, in the presence of hydrogen peroxide and halogen ions, a hypohalide ion which has a strong oxidizing activity and a powerful halogenating character to cause irreversible changes in the moiety of protein or of nucleic acid in bacteria, fungi, viruses or the like. This would presumably be the mechanism underlying the pharmacological effect of myeloperoxidase, such as destruction of bacteria and viruses or inactivation of the latter.

As described above, the properties of myeloperoxidase are suggestive of a useful pharmaceutical. However, myeloperoxidase isolated from foreign animal species is to be biologically hazardous in causing side effects due to the antigen-antibody reaction, which would make difficult to be aministered repeatedly. However, myeloperoxidase of the human origin is extremely difficult to obtain in large quantities due to the limited sources. For the above reasons, myeloperoxidase is generally considered impossible to be applied clinically and has never been in practical use.

Under these circumstances, the present inventors carried out extensive studies to isolate and purify myeloperoxidase of the human origin on an industrial scale. As a result, it was found that when an aqueous suspension of a disintegrated product of human myelogenous leukocytes is admixed with at least one member selected from the group consisting of manganese salts and protamine sulfate, the suspension separates into a supernatant containing myeloperoxidase and a precipitate of impurities. It was further found that highly pure human myeloperoxidase can be separated and recovered on an industrial scale from the said supernatant by first recovering a myeloperoxidase-containing fraction by centrifugation and contacting the fraction with a cation exchanger to adsorb myeloperoxidase which can then be eluted and recovered.

The present inventors further conducted studies on the myeloperoxidase and found that a composition comprising myeloperoxidase and an alkali metal halide in a specific ratio can exhibit, in the absence of hydrogen peroxide, the aforementioned pharmacological effect on these microorganisms which are deficient or diminished in catalase synthesizing system. It was further found that such a composition can be administered in large quantities by injection, indicating that a dramatic therapeutic effect of myeloperoxidase is expected on the diseases caused by the infection of above-noted microorganisms. Based on the above findings, the present invention has been accomplished.

An object of this invention is to provide a method for recovering myeloperoxidase on an industrial scale from human myelogenous leukocytes.

Another object of this invention is to provide a myeloperoxidase-containing pharmaceutical composition effective against microorganisms deficient or diminished in catalase synthesizing system.

Other objects and advantages of this invention will become apparent from the following description.

According to this invention, there is provided a method for separating and recovering myeloperoxidase, which comprises admixing an aqueous dispersion of a disintegration product of human myelogenous leukocytes with at least one member selected from the group consisting of manganese salts and protamine sulfate, and separating and recovering myeloperoxidase from the supernatant liquor; there is further provided a method for separating and recovering myeloperoxidase by separating a myeloperoxidase fraction from the said supernatant liquor by centrifugation and then contacting the fraction with a cation exchanger to absorb the myeloperoxidase thereto. In another embodiment of the invention, heat treatment can be performed in any step of the above methods at a temperature of 50° C. or higher, preferably 50° to 80° C. for 8 to 36 hours.

Further, according to this invention, there is provided a pharmaceutical composition effective against microorganisms deficient or diminished in catalase synthesizing system, comprising 5 to 0.05 m moles of an alkali metal halide for 100 to 0.05 units of myeloperoxidase.

The starting material for the recovery of myeloperoxidase is a disintegration product of human myelogenous leukocytes containing myeloperoxidase to be separated and recovered.

In man, the leukocyte cells generally occupy 60 to 70% of the white blood cells in the generic sense containing no respiratory pigment found in the blood (hereinafter such white cells are referred to "white cells in the generic sense"). Although the disintegration product of such leukocytes can be used as the starting material in the present method, yet it is preferred to remove preliminary solid constituents of the blood such as erythrocytes and platelets as well as blood plasma. At present the white cells in the generic sense are used for the purpose of utilizing lymphocytes contained therein in the induced production of interferon which is now attractive attention as a broad spectrum antimicrobial agent. The residual leukocytes after the separation of interferon can of course be used as the starting material.

The disintegration product of human myelogenous leukocytes used in the present method is obtained by the disintegration of the above-noted raw materials. The disintegration is effected usually by treating an aqueous suspension of leukocyte cells in a homogenizer at 0° C. for 5 minutes.

Before being submitted to the next step of admixing with at least one of the manganese salts, and protamine sulfate, the above aqueous suspension is preferably separated into a precipitate and a supernatant layer by centrifugation (10,000 r.p.m.). The yellowish green supernatant is recovered as a myeloperoxidase-containing fraction and suspended in 50 to 100 times (V/V) as much of a buffer solution (pH 6.0–8.0) containing potassium sulfate or TRIS and 5 to 15% (W/V) of ammonium sulfate. The resulting suspension is then homogenized.

In the next step, the homogenized suspension is admixed with at least one compound selected from manganese salts and protamine sulfate. By the addition of such a salt, the myeloperoxidase remains in the supernatant and is very easily separated and recovered. Suitable manganese salts include those manganese compounds which are capable of producing a manganese ion such as, for example, manganese sulfate, manganese nitrate or manganese choloride. Of these, manganese sulfate is preferred. The amount to be added of these salts is such that the ultimate concentration will become generally 5 to 20 mM, preferably 8 to 10 mM for manganese salts and 0.1 to 0.02% (W/V), preferably 0.2 to 0.01% (W/V) for protamine sulfate. After the addition of the salt, the suspension is centrifuged (10,000 r.p.m.) to recover the myeloperoxidase fraction, that is, the supernatant which is then subjected to cation exchanger column chromatography to separate the myeloperoxidase. Before being subjected to the column chromatography, the supernatant is preferably dialyzed and centrifuged to remove the precipitate.

The myeloperoxidase preferentially adsorbed onto the cation exchanger is then eluted to be recovered. The cation exchangers of various acidities ranging from strongly acidic to weakly acidic pH can be used without any particular restriction. The adsorption is markedly enhanced at pH 5.5 to 8.0, particularly 7.0 to 7.5. In actual practice, it is preferable to conduct the adsorption from a low concentration buffer (for example, 10–80 mM phosphate buffer or 50–80 mM dipotassium hydrogen phosphate solution) of the adjusted pH. The elution is carried out by first washing with an equilibrated buffer solution, then treating with buffer solutions of increased salt concentration (in a preferred embodiment, the phosphate concentration gradually increased from 80 mM up to 400 mM) to recover the myeloperoxidase activity fraction.

The recovered effluent aqueous solution is green in color and the yield of the recovered myeloperoxidase is about 40%. For instance, 8815 units in total [as determined by the method of B. Chance et al. described in "Methods in Eenzymology," II, p. 764 (1955)] of myeloperoxidase is obtained from $1.47\times10^{11}$ leukocyte cells. The aqueous solution of myeloperoxidase thus obtained is subjected to a series of treatments common in the production of pharmaceuticals, such as dialysis, aseptic filtration, filling up in vials and lyophilization to be offered as pharmaceutical.

If necessary, a step of heat treatment at 50° to 70° C. for 8 to 36 hours can be supplemented to the method of this invention. This treatment is carried out in an aqueous solution or aqueous suspension of pH 5 to 8 for the purpose of inactivating various viruses and bacteria which might contaminate a blood preparation. It can be carried out at any stage of the processing. When the myelogenous leukocytes, the raw material, are heat treated, the removal of thermolabile substances by precipitation will be achieved at the same time, resulting in increased purification efficiency. It is of course possible to heat-treat the final product.

Further, in a preferred embodiment of this invention, a step of gel filtration can be supplemented. In this step, a carrier suitable for the separation of a substance having a molecular weight of about 3,000 to 150,000 Dalton (for example, polyacrylamide gels such as Sephadex G-200 and Biogel P-300 or agarose gels such as Sepharose 6B) is used. It is preferable to subject the product to gel filtration after being treated with a cation exchanger. By the gel filtration treatment, impurities of low molecular weights are removed and there is obtained a product which shows satisfactory uniformity on electrophoretic analysis (with a gel of pH 4.0, 1.5 hours of electrophoresis at room temperature).

The method of this invention described above is able to produce a highly pure human myeloperoxidase in high yield on an industrial scale. Since the product contains substantially no impurities and is of human origin, it can be used as a safe pharmaceutical without having a danger of side effects due to the presence of heterogeneous protein antigens.

In the pharmaceutical composition of this invention, the myeloperoxidase purified by the present method is used preferably but not exclusively and it is possible to use any of those which were produced by the methods capable of achieving a purification degree as high as that obtained by the present method.

The alkali metal halide used in this invention can be any of those which are pharmacologically acceptable, for example, chlorides and iodides of alkali metals (for example, potassium and sodium).

The proportion of the alkali metal halide in the composition is generally 5 to 0.05 m moles, preferably 1 to 0.1 m mole for 100 to 0.5 units of myeloperoxidase.

The pharmaceutical composition according to this invention is prepared in any customary way after the addition of an alkali metal halide to purified myeloperoxidase. If necesary, this composition can be further incorporated with any of the known pharmaceutical carriers, diluents, stabilizers, activators, and preservatives.

The pharmaceutical composition thus prepared exhibits, in vivo, distinctive germicidal activity against pathogenic microorganisms deficient or diminished in catalase synthesizing activity. The composition has also a therapeutic effect upon diseases caused by the infection of said microorganisms. The term "Pathogenic microorganisms deficient or diminished in catalase synthesizing activity," as used herein, means those pathogenic microorganisms which are deficient or diminished in the enzymatic activity of extracellular production of catalase in a living body infected with said microorganisms. A typical example is a tubercle bacilli resistant against isonicotinic acid hydrazide (INH). The pharmaceutical composition of this invention, therefore, is useful in treating, for example, intractable tuberculosis, resistant to chemotherapy and to antibiotic agents.

In the case of an injection as an example, before use the present composition is dissolved in saline for injection to make about 100 to 1,000 units/ml solution of myeloperoxidase and administered, preferably locally, to a living body.

The administration can be performed parenterally. Although local administration is preferable, the present composition can be applied externally. In actual practice, it is administered, for example, intravenously (in the case of systemic disease such as, septicemia or miliary tuberculosis), intramuscularily, or by spraying into the airway.

The dose of the present composition to be administered to a living body depends upon the route of administration, the disease to be treated, and the symptoms. In the case of intravenous injection or local administration, the daily dose for an adult is 100 to 1 unit/kg of body weight.

The germicidal activity, obtained from animal tests, and the acute toxicity for the present composition are described below. The activity unit of myeloperoxidase was assayed according to the method described by B. Chance et al. in "Methods in Eenzymology," II, 764 (1955).

(1) Germicidal activity:

In order to test the germicidal activity of the present pharmaceutical composition, various compositions comprising myeloperoxidase and a halide were prepared. The effect of the presence of hydrogen peroxide was examined as reference. The test was performed by dissolving each constituent in 0.1 M potassium phosphate buffer (pH 7.0) to prepare a test mixture comprising 1 ml of an aqueous myeloperoxidase solution, 1 ml of potassium iodide solution (the KI content was shown in Table 1), 1 ml of hydrogen peroxide solution (the $H_2O_2$ content was shown in Table 1) and 1 ml of bacterial suspension, then incubating each mixture at 37° C. for 60 minutes, and counting the number of bacteria survived. The results obtained were as shown in Table 1.

TABLE 1

| Constituent | | | Number of bacteria survived | | | | |
|---|---|---|---|---|---|---|---|
| Myeloperoxidase, units | KI, mmole | $H_2O_2$, mmole | *Staphylococcus aureus* | *Pseudomonas aeruginosa* | *Candida albicans* | *Mycobacterium tuberculosis* | *Mycobacterium tuberculosis* resistant to INH |
| 100 | 5.0 | 2.0 | 0 | 0 | 0 | 0 | 0 |
| 20 | " | " | " | " | " | " | " |
| 1 | " | " | " | " | " | " | " |
| 0.1 | " | " | $3.2 \times 10$ | $2.9 \times 10$ | $2.8 \times 10$ | $3.1 \times 10$ | $1.8 \times 10$ |
| 0.01 | " | " | $2.5 \times 10^3$ | $3.1 \times 10^3$ | $3.1 \times 10^2$ | $2.8 \times 10^2$ | $1.3 \times 10^3$ |
| 0 | " | " | $3.8 \times 10^5$ | $2.0 \times 10^7$ | $1.3 \times 10^6$ | $1.1 \times 10^6$ | $1.2 \times 10^6$ |
| 100 | 1.0 | " | 0 | 0 | 0 | 0 | 0 |
| 20 | " | " | " | " | " | " | " |
| 1 | " | " | " | " | " | " | " |
| 0.1 | " | " | $4.5 \times 10$ | $3.3 \times 10$ | $2.3 \times 10$ | $2.1 \times 10$ | $2.4 \times 10$ |
| 0.01 | " | " | $3.1 \times 10^3$ | $4.2 \times 10^2$ | $2.1 \times 10^2$ | $1.8 \times 10^2$ | $1.9 \times 10^2$ |
| 0 | " | " | $2.2 \times 10^6$ | $1.4 \times 10^7$ | $1.3 \times 10^6$ | $1.6 \times 10^6$ | $1.3 \times 10^6$ |
| 100 | 0.1 | 2.0 | 0 | 0 | 0 | 0 | 0 |
| 20 | " | " | " | " | " | " | " |
| 1 | " | " | " | " | " | " | " |
| 0.1 | " | " | $3.8 \times 10^2$ | $4.4 \times 10^2$ | $1.8 \times 10^3$ | $1.9 \times 10^2$ | $1.8 \times 10^3$ |
| 0.01 | " | " | $4.1 \times 10^3$ | $4.6 \times 10^2$ | $4.8 \times 10^3$ | $2.1 \times 10^3$ | $2.9 \times 10^3$ |
| 0 | " | " | $3.4 \times 10^6$ | $1.1 \times 10^7$ | $1.3 \times 10^7$ | $1.1 \times 10^7$ | $1.0 \times 10^7$ |
| 100 | 0.01 | 2.0 | 0 | 0 | 0 | 0 | 0 |
| 20 | " | " | $3.1 \times 10$ | $2.8 \times 10$ | $2.1 \times 10$ | $1.9 \times 10$ | $1.3 \times 10$ |
| 1 | " | " | $1.3 \times 10^2$ | $1.9 \times 10^2$ | $2.5 \times 10^2$ | $2.1 \times 10^2$ | $5.1 \times 10$ |
| 0.1 | " | " | $1.5 \times 10^3$ | $2.3 \times 10^4$ | $1.8 \times 10^3$ | $2.3 \times 10^3$ | $1.3 \times 10^2$ |
| 0.01 | " | " | $5.4 \times 10^5$ | $4.8 \times 10^5$ | $2.1 \times 10^5$ | $1.8 \times 10^4$ | $1.9 \times 10^3$ |
| 0 | " | " | $3.3 \times 10^6$ | $1.9 \times 10^7$ | $1.1 \times 10^7$ | $1.4 \times 10^6$ | $1.1 \times 10^7$ |
| 100 | 0.001 | " | $1.5 \times 10^5$ | $4.8 \times 10^4$ | $1.8 \times 10^4$ | $1.3 \times 10^4$ | $1.5 \times 10^4$ |
| 20 | " | " | $1.8 \times 10^5$ | $5.3 \times 10^4$ | $2.3 \times 10^4$ | $1.9 \times 10^5$ | $2.5 \times 10^4$ |
| 1 | " | " | $1.4 \times 10^6$ | $1.1 \times 10^5$ | $3.1 \times 10^5$ | $3.1 \times 10^5$ | $3.1 \times 10^5$ |
| 0.1 | " | " | $1.8 \times 10^6$ | $1.3 \times 10^6$ | $3.9 \times 10^5$ | $2.8 \times 10^6$ | $3.9 \times 10^5$ |
| 0.01 | 0.001 | 2.0 | $2.1 \times 10^6$ | $4.8 \times 10^6$ | $2.1 \times 10^6$ | $1.8 \times 10^7$ | $1.7 \times 10^6$ |
| 0 | " | " | $2.9 \times 10^6$ | $1.1 \times 10^7$ | $1.3 \times 10^7$ | $2.1 \times 10^7$ | $2.1 \times 10^7$ |
| 20 | 1.0 | 0.1 | 0 | 0 | 0 | 0 | 0 |
| 20 | 1.0 | 0 | $3.4 \times 10^5$ | $1.1 \times 10^6$ | $1.3 \times 10^6$ | $1.2 \times 10^6$ | $1.8 \times 10^6$ |
| 20 | 0 | 0 | $1.1 \times 10^7$ | $1.3 \times 10^6$ | $1.8 \times 10^6$ | $1.9 \times 10^6$ | $1.7 \times 10^6$ |
| 0 | 2.0 | 0 | $2.2 \times 10^7$ | $7.1 \times 10^6$ | $3.1 \times 10^6$ | $4.1 \times 10^6$ | $5.1 \times 10^6$ |
| Initial number of bacteria in 1 ml | | | $3.7 \times 10^7$ | $1.8 \times 10^7$ | $2.9 \times 10^7$ | $1.8 \times 10^7$ | $1.7 \times 10^7$ |

(2) Animal experiment (1) The effect of the present pharmaceutical composition (50 units of myeloperoxidase and 2 m moles of sodium iodide per ml) on the experimental infectious disease caused by tubercle bacillus was examined, using 3 groups of Wistar strain rats, 200–250 g in body weight, each group consisting of 5 rats. INH-resistant tubercle bacilli, $3.7 \times 10^8$ microorganisms, were suspended in 1 ml of an aqueous solution and 0.05 ml of the resulting suspension was injected into the nasal cavity of each rat.

The first group of rats was used as control and was administered no pharmaceutical composition. The second group, after two weeks from inoculation of the bacillus, was sprayed with the present composition four times in 8 hours interval, each time using 2 ml of the composition and spraying for 15 minutes. The third group was sprayed with the composition for 15 minutes before the inoculation of the bacillus injection and was sprayed four times after the bacillus injection. The spraying was carried out by placing the rat in a desiccator, 35 cm in diameter, provided with a false bottom, and a mist of the pharmaceutical composition generated by means of a nebulizer was introduced below the false bottom and released from the top of the desiccator.

The pharmaceutical effect was evaluated in terms of mortality of rat after 6 months. The results obtained were as shown in Table 2.

TABLE 2

| | Number of survived rats |
|---|---|
| 1st group | 0/5 |
| 2nd group | 5/5 |
| 3rd group | 5/5 |

As is apparent from Table 2, all rats of the group administered with no pharmaceutical composition were dead, whereas all rats of the administered groups were alive.

(2) An acute toxicity test was performed by administering myeloperoxidase, 2130 units/kg, and sodium iodide, 210 mg/kg, to a group of four dd strain male mice, 16.5–20.0 g in body weight.

The pharmaceutical composition was administered through the vena coccygea. After 72 hours and after 7 days from the administration, all mice were alive in healthy condition. Upon autopsy after 7 days, no abnormality was observed in the internal organs of all mice.

From the results obtained above, it may be presumed that therapeutic effect will be manifested in man by the administration of 100–0.05 total units of myeloperoxidase and 5–0.05 m mole of a halide.

The present invention first made it possible to use myeloperoxidase as a pharmaceutical and to provide an excellent pharmaceutical composition having a promising and unprecedented therapeutic effect.

The invention is illustrated below with reference to Examples, but the invention is not limited thereto.

EXAMPLE 1

About one liter of a suspension of $1.47\times10^{11}$ white blood cells (white cells in generic sense) was treated at 0° C. for 5 minutes in a homogenzier operating at 30,000 r.p.m. to disintegrate the cells. The resulting suspension was centrifuged at 0° to 10° C. for 20 minutes to obtain a yellowish green supernatant liquid (total activity of 22,493 units). To the supernatant was added manganese sulfate to a final concentration of 5 to 10 mM. The precipitate was removed by centrifugation. The supernatant was desalted by dialysis against 80 mM aqueous solution of dipotassium hydrogen phosphate using cellophane tube as semipermeable membrane. The desalted solution was fed to a column packed with about 60 ml of CM-Sephadex C-50 (Pharmacia Co., Sweden) which had been equilibrated with 80 mM aqueous dipotassium hydrogen phosphate solution. The column was washed with the same aqueous solution as used in equilibration and then eluted by the method of linear concentration gradient using 80 mM and 400 mM aqueous dipotassium hydrogenphosphate solutions. The intended fraction was recovered from the eluate by measuring absorbances at 280 nm and 430 nm, the latter being a wave length characteristic of myeloperoxidase.

EXAMPLE 2

The procedure of Example 1 was repeated, except that protamine sulfate was used (final concentration of 0.1–0.02%) in place of the manganese sulfate; SP-Sephadex C-50 (Pharmacia Co.) equilibrated with 50 mM phosphate buffer (pH 7.5) was used in place of the CM Sephadex C-50; and after washing the column with 50 mM aqueous dipotassium hydrogenphosphate, the column was eluted by the method of linear concentration gradient using 50 mM and 200 mM dipotassium hydrogen phosphate solutions. The results obtained were similar to those in Example 1.

EXAMPLE 3

Similar results to those in Example 1 were obtained by repeating the procedure of Example 1, except that the recovered myeloperoxidase fraction was adjusted to pH 5–7 and heat treated at 60° C. for one hour.

EXAMPLE 4

After the final step of Example 1, the product was subjected to the gel filtration using Sephadex G-200 (2.5×16 cm column; after having been equilibrated with 0.1 M phosphate buffer of pH 7.0, the column was developed with the same buffer as used in equilibration). There was obtained a high-purity product. The increase in purity and the yield were as shown in Table 3.

TABLE 3

| Means of purification | Total volume (ml) | Absorbance (280 nm) | (430 nm) | (430mn/280nm) | Total activity (units) | Yield (%) |
|---|---|---|---|---|---|---|
| Extract solution | 1,059 | 15.18 | — | — | 22,493 | 100 |
| Dialyzed solution | 1,170 | 5.53 | 0.281 | 0.05 | 12,747 | 56.7 |
| After CM-Sephadex treatment | 282 | 0.305 | 0.204 | 0.67 | 8,815 | 39.2 |
| After gel filtration | 47 | 1.170 | 0.974 | 0.83 | 5,182 | 23.0 |

EXAMPLE 1 of pharmaceutical preparation (injection and spray)

Pharmaceutical solutions were aseptically filled in brown vials so that each vial may contain 100 units of myeloperoxidase and 3 m moles of sodium iodide, then lyophilized and sealed. Just before use, 5 ml of physiological saline for injection is added to each vial to dissolve the contents and to obtain an injection.

What is claimed is:

1. A method for separating myeloperoxidase, which comprises admixing an aqueous suspension of a disintegration product of human myelogenous leukocytes with at least one member selected from the group consisting of manganese salts, and protamine sulfate and then separating and recovering myeloperoxidase from the supernatant liquor.

2. A method according to claim 1, wherein the separation and recovery of myeloperoxidase are effected by recovering a myeloperoxidase fraction from the supernatant liquor by centrifugation and contacting the recovered fraction with a cation exchanger to adsorb the myeloperoxidase thereto.

3. A method according to claim 1, wherein heat-treatment is carried out at 50° to 70° C. for 8 to 36 hours at any desired stage during the separation of myeloperoxidase.

4. A method according to claim 1, wherein there is employed a manganese salt and it is manganese sulfate, manganese nitrate or manganese chloride.

5. A method according to claim 1, wherein the amount to be added of a manganese salt corresponds to a final concentration of 5 to 20 mM and the amount to be added of protamine sulfate corresponds to a final concentration of 0.1 to 0.02% (W/V).

6. A method according to claim 2, wherein the contact with a cation exchanger is carried out at pH 5.5–8.0.

7. A method according to claim 1, wherein the recovered product is further subjected to gel filtration.

8. A method according to claim 1 wherein there is employed protamine sulfate.

* * * * *